US008561235B2

(12) United States Patent
Oh et al.

(10) Patent No.: US 8,561,235 B2
(45) Date of Patent: Oct. 22, 2013

(54) COVER FOR A SELF-ADJUSTING MATTRESS THAT SECURES A FITTED SHEET

(75) Inventors: Suk Kan Oh, Xiamen (CN); Youn Jae Lee, Pleasanton, CA (US)

(73) Assignee: Zinus, Inc., San Leandro, CA (US)

( * ) Notice: Subject to any disclaimer, the term of this patent is extended or adjusted under 35 U.S.C. 154(b) by 349 days.

(21) Appl. No.: 12/924,339

(22) Filed: Sep. 25, 2010

(65) Prior Publication Data

US 2012/0073059 A1 Mar. 29, 2012

(51) Int. Cl.
*A47C 21/02* (2006.01)

(52) U.S. Cl.
USPC ..... 5/692; 5/485; 5/496; 5/498; 5/499; 5/722

(58) Field of Classification Search
USPC ..... 5/613, 616–618, 504.1, 485, 495–500, 5/502, 411, 482, 692, 722; 24/72.5
See application file for complete search history.

(56) References Cited

U.S. PATENT DOCUMENTS

| | | | | | |
|---|---|---|---|---|---|
| 2,154,910 | A | * | 4/1939 | Magaril | 5/722 |
| 2,649,595 | A | | 8/1953 | Lewin | 5/345 |
| 4,809,375 | A | * | 3/1989 | Bull | 5/722 |
| 4,893,365 | A | | 1/1990 | Justice | 5/68 |
| 4,962,546 | A | * | 10/1990 | Vitale | 5/497 |
| 5,133,097 | A | * | 7/1992 | Pyles | 5/623 |
| 5,214,809 | A | * | 6/1993 | Stuart | 5/716 |
| 5,638,562 | A | * | 6/1997 | Masoncup | 5/493 |
| 5,737,783 | A | | 4/1998 | Antinori | 5/411 |
| 5,791,001 | A | * | 8/1998 | Wang | 5/716 |
| 5,794,285 | A | * | 8/1998 | Burch | 5/497 |
| 5,953,778 | A | * | 9/1999 | Hiatt | 5/716 |
| 5,978,992 | A | | 11/1999 | Antinori | 5/658 |
| 6,061,852 | A | | 5/2000 | Bathrick et al. | 5/618 |
| 6,098,219 | A | * | 8/2000 | Milber | 5/494 |
| 6,178,574 | B1 | * | 1/2001 | Stromatt et al. | 5/485 |
| 6,253,398 | B1 | * | 7/2001 | Yim | 5/499 |
| 6,408,470 | B1 | | 6/2002 | Powers | 5/735 |
| 6,742,205 | B2 | * | 6/2004 | Dewert | 5/618 |
| 6,754,922 | B2 | | 6/2004 | Dewert | 5/617 |
| 6,889,396 | B2 | | 5/2005 | Weinman | 5/411 |
| 7,107,642 | B2 | | 9/2006 | Wong et al. | 5/713 |
| 7,152,262 | B2 | * | 12/2006 | Ikeda et al. | 5/618 |
| 7,395,568 | B2 | * | 7/2008 | Damewood | 5/722 |
| 7,487,560 | B2 | * | 2/2009 | McGrath et al. | 5/488 |
| 8,082,612 | B2 | * | 12/2011 | Saunders | 5/499 |
| 2008/0028535 | A1 | | 2/2008 | Rodrigues | 5/722 |

* cited by examiner

*Primary Examiner* — Nicholas Polito
(74) *Attorney, Agent, or Firm* — Imperium Patent Works; Darien K. Wallace

(57) ABSTRACT

An adjustable mattress that incorporates a movement mechanism and support member inside of the foam mattress includes a fabric covering with a fastener member. The fastener member is used to keep a fitted sheet in place over the adjustable mattress when the mattress is adjusted to an inclined configuration. The fastener member is attached to the fabric covering near the lower edge of the adjustable mattress and is adapted to fasten to a corresponding fastener on the fitted sheet. The fastener member can be a toggle that fits through a loop on the fitted sheet. The fitted sheet also has an elastic band that draws the fitted sheet taut around the adjustable mattress. The lower portion of the fabric covering is made of stretchable fabric that stretches between the lower edge of the adjustable mattress and a balancing bar that supports the adjustable mattress when the adjustable mattress is inclined.

14 Claims, 7 Drawing Sheets

COVER FOR A SELF-ADJUSTING MATTRESS THAT SECURES A FITTED SHEET

TECHNICAL FIELD

The present invention relates to adjustable beds, and in particular to a means for securing a fitted sheet to a self-adjusting mattress.

BACKGROUND INFORMATION

Adjustable beds have long been used in hospitals and convalescent centers. Besides allowing recovering patients to lie in different positions, adjustable beds permit average consumers to read or to watch television more comfortably in bed. The average American household, however, does not have an adjustable bed. Besides being associated with the sick and elderly, conventional adjustable bed designs are unattractive and cumbersome. Evidently, the average American houseful considers these disadvantages to outweigh the added comfort and convenience that adjustable beds provide.

FIG. 1 (prior art) illustrates some of the disadvantages of a conventional adjustable bed 10. Conventional adjustable bed 10 cannot be used in combination with a box spring or platform bed. The mattress 11 of conventional adjustable bed 10 rests on an adjustable support member 12 instead of on a box spring. Adjustable support member 12 is connected to a movement mechanism (not shown) and to a frame 13 with wheels 14. The wheeled frame, support member and movement mechanism do not easily fit on top of a box spring or platform bed. In order to use conventional adjustable bed 10, the consumer must forego the aesthetic qualities of a platform bed or a box spring framed by a headboard and footboard. Consequently, conventional adjustable bed 10 imparts the appearance of a hospital room as opposed to a bedroom.

Another disadvantage of conventional adjustable bed 10 is that mattress 11 does not bend sufficiently in an inclined sitting position to conform to the underlying adjustable support member. Adjustable bed 10 in FIG. 1 is in an inclined sitting position. Mattress 11 in the section below an occupant's hips has not bent sufficiently to conform to adjustable support member 12 and has created a gap 15. Because mattress 11 does not adequately conform to the shape of adjustable support member 12, the sleeping surface of mattress 11 does not achieve the configuration formed by adjustable support member 12, and the occupant of adjustable bed 10 does not benefit from the desired resting position. The various sitting and reclining positions achieved by adjustable bed 10 depend on which mattress is used.

Yet another disadvantage of conventional adjustable bed 10 is that mattress 11 tends to shift or slide from side to side and from end to end when the occupant enters and exits the bed. In an attempt to solve this problem, some conventional adjustable beds employ a foot rail. For example, adjustable bed 10 has a foot rail 16 in the shape of a bent metal tube. Foot rail 16 does not, however, prevent mattress 14 from protruding beyond the top of adjustable support member 11 when adjustable bed 10 is placed in the elevated sitting position, as shown in FIG. 1. In addition, foot rail 16 is a metal bar near the sleeping surface of the foot of mattress 11. An occupant's foot could hit the metal bar if the occupant's leg is energetically lowered over the end of mattress 11.

And foot rail 16 does not prevent mattress 11 from shifting from side to side. FIG. 1 shows that the foot of mattress 11 has shifted to the occupant's right, and the head of mattress 11 has shifted to the left from the perspective of a reclining occupant. Mattress 14 will be increasingly skewed after each exit and entry into adjustable bed 10.

Recently, an adjustable bed has been developed that overcomes these disadvantages. A novel adjustable bed that incorporates the movement mechanism and support members inside the mattress requires no foot rails or other retaining means to prevent the mattress from shifting over an underlying adjustable support member. The mattress of the novel adjustable bed assumes the desired configurations and does not need to conform to the configuration of an underlying adjustable support member. And the novel adjustable bed can be used on a platform bed. Nevertheless, the novel adjustable bed creates some complications due to its one-piece structure. For example, bedding cannot be "tucked in" between the mattress and a non-existent support member or box spring. Moreover, sheets become loose when the novel adjustable bed is placed in an inclined position. A means is sought that permits bedding to be retained on a one-piece adjustable bed that incorporates the movement mechanism and support members inside the mattress.

SUMMARY

A novel mattress covering and fitted sheet have fasteners that keep the fitted sheet in place over a one-piece adjustable mattress that incorporates both the movement mechanism and the support member inside the foam mattress. A fastener member on the fabric mattress covering is used to keep a fitted sheet in place over the adjustable mattress when the mattress is adjusted to an inclined configuration. The fastener member is attached to the fabric covering near the lower edge of the adjustable mattress and is adapted to fasten to a corresponding fastener on the fitted sheet. In one embodiment, the fastener member is a toggle that fits through a corresponding loop on the fitted sheet. The fastener member and corresponding fastener on the fitted sheet can also be a button and a button hole, a male snap fastener and a female snap fastener, a hook fastener strip and a loop fastener strip, or simply two tie strings.

The lower portion of the fabric mattress covering is made of stretchable fabric that stretches between the lower edge of the adjustable mattress and a balancing bar that supports the adjustable mattress when the adjustable mattress is inclined. The movement mechanism of the adjustable mattress includes an electric motor that is disposed between the top surface and lower edge of the adjustable mattress. The electric motor is adapted to incline the adjustable mattress into various configurations, including a position that is comfortable for reading or watching television.

A novel fitted sheet has a fabric portion, an elastic band and fasteners. The fabric portion has a form that conforms to an upper surface and the four side surfaces of the adjustable mattress. The elastic band is attached to the bottom edge of the fabric portion and is adapted to draw the fitted sheet taut around the adjustable mattress. The fasteners are attached to the bottom edge of the fabric portion and are adapted to fasten to corresponding fastener members that are attached to the fabric covering of the adjustable mattress. In one embodiment, the fasteners are elastic loops, and the fastener members are toggles. The fabric portion of the fitted sheet includes a pocket at the hip section of the adjustable mattress that is adapted to hold a remote control device used to control the adjustable mattress.

A method of manufacturing an adjustable mattress includes attaching a bottom mattress layer and a top mattress layer, and then encasing the mattress in a fabric covering. A bottom foam layer is attached to a support member that includes a shoulder section, a hip section, a leg section and a foot section. The hip section is pivotally connected to both the shoulder section and to the leg section. The top foam layer is then attached to the bottom foam layer such that the support member is disposed between the top surface of the top foam layer and the bottom surface of the bottom foam layer. An electric motor is connected to the support member such that the electric motor is disposed between the top surface of the top foam layer and the bottom surface of the bottom foam layer. The electric motor is adapted to incline the shoulder section and the leg section relative to the hip section.

The top foam layer, the support member and the bottom foam layer are then encased in a fabric covering that includes fastener members attached to the fabric covering near the perimeter of the bottom surface of the bottom foam layer. Each of the fastener members is adapted to fasten to a corresponding fastener on a fitted sheet. The fastener members serve as a means for holding the bottom edge of the fitted sheet around the lower edge of the adjustable mattress when the adjustable mattress is in an inclined position.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 1:
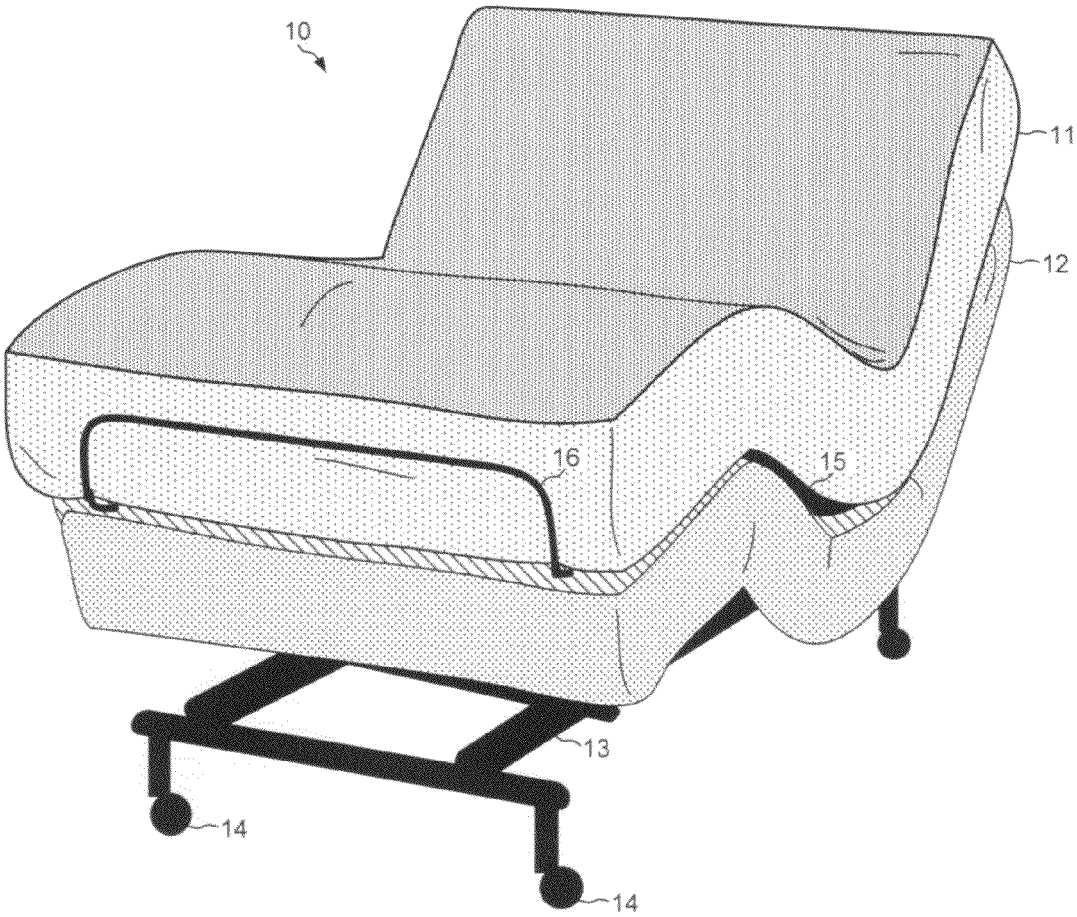
FIG. 1 (PRIOR ART)
FIG. 1 (prior art) is a perspective view of a conventional adjustable bed whose mattress is retained by a foot rail and conforms only partly to the configuration of the adjustable support member upon which the mattress rests.
Figure 2:
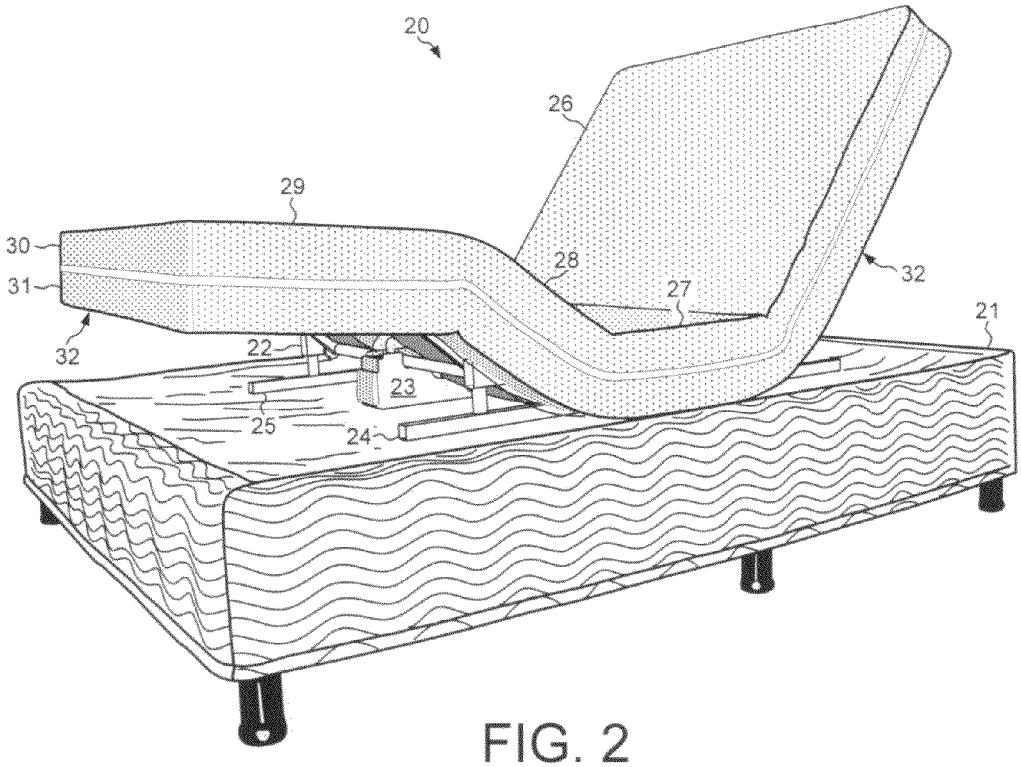
FIG. 2 is a perspective view of a self-adjusting mattress without its covering in an inclined configuration on top of a box spring base.

FIG. 2 is a perspective view of an adjustable mattress 20 in an inclined configuration on top of a box spring base 21. Adjustable mattress 20 has a support member 22 and a movement mechanism 23 that are integrated into a foam mattress. Only a small portion of the steel frame of the integrated support member 22 is visible when mattress 20 is in the inclined configuration in FIG. 2. Balancing bars 24-25 are attached to support member 22. The support member includes an shoulder section 26, a hip section 27, a leg section 28 and a foot section 29. Hip section 27 is pivotally connected to both shoulder section 26 and to leg section 28. Mattress 20 can adjust itself from a flat configuration into one of multiple inclined configurations without a separate adjustable support member as used by conventional adjustable beds. FIG. 2 shows mattress 20 in one predetermined inclined configuration that would be comfortable for reading or watching television. Mattress 20 can be placed directly on a conventional box spring or platform bed just as a typical foam mattress. Thus, mattress 20 can be used in place of an old mattress on an existing platform bed or box spring. The user of mattress 20 need not forego the aesthetic qualities of the platform bed or headboard and footboard.

Mattress 20 is shown in FIG. 2 without its fabric covering. Movement mechanism 23 and balancing bars 24-25 are visible beneath inclined leg section 28 and elevated foot section 29. Hip section 27 is pivotally connected to both shoulder section 26 and to leg section 28. Leg section 28 is pivotally connected to foot section 29. Elevation arms are pivotally connected both to foot section 29 and to support member 22 at hip section 27. The elevation arms cause foot section 29 to remain nearly parallel to hip section 27 as leg section 28 inclines. Balancing bars 24-25 do not extend out beneath foot section 29 and thereby impart the appearance that self-adjusting foam mattress 20 is self-elevating. No separate adjustable support member as required by the prior art is used to incline and elevate the foam layers of adjustable mattress 20. Thus, adjustable mattress 20 can be placed directly on the top surface of box spring base 21 that would otherwise support a conventional mattress. When adjustable mattress 20 is in the flat configuration, mattress 20 looks like a conventional mattress resting on a box spring.

Movement mechanism 23 is encased in a central elongated unit that includes gears and two electric motors. One electric motor causes shoulder section 26 to incline relative to hip section 27. The other electric motor causes the elevation arms to incline relative to hip section 27. Adjustable mattress 20 includes a top foam layer 30 and a bottom foam layer 31. The electric motors are disposed between the top surface of top foam layer 30 and the bottom surface of bottom foam layer 31. Top foam layer 30 is glued, laminated or molded over bottom foam layer 31. A novel mattress cover (not shown in FIG. 2) encases top foam layer 30, support member 22, bottom foam layer 31, movement mechanism 23 and balancing bars 24-25. The mattress cover is made of a stretchable material, such as Spandex® or Lycra®, that can stretch over the bottom of adjustable mattress 20 from the balancing bars 24-25 to the upper edge of shoulder section 26 when shoulder section 26 is inclined.

Top foam layer 30 has a top surface that forms the sleeping surface of adjustable mattress 20 just below the mattress cover. Bottom foam layer 31 has a bottom surface that rests on the mattress cover on the supporting surface of a box spring or platform bed when adjustable mattress 20 is in a flat configuration. In the inclined configuration shown in FIG. 2, only the portion of the bottom surface that is beneath hip section 27 rests on the box spring or platform bed; the remaining portions of the bottom surface of bottom foam layer 31 are elevated. Support member 22 is disposed completely between the top surface of top foam layer 30 and the bottom surface of bottom foam layer 31. In the embodiment of FIG. 2, bottom foam layer 31 is molded around support member 22 and completely encases support member 22. Top foam layer 30 is then glued, laminated or molded on top of bottom foam layer 31. For additional details on the novel self-adjusting mattress 20, see U.S. patent application Ser. No. 12/798,638 entitled "A Self-Adjusting Mattress with Balancing Bars and an Integrated Movement Mechanism," filed on Apr. 7, 2010, which is incorporated herein by reference.

The one-piece structure of the novel adjustable bed, however, complicates a user's efforts to maintain bedding in place on mattress 20. There is no adjustable support member of the prior art to hold bedding between the mattress and the support member. And sheets do not remain tucked in between mattress 20 and box spring base 21 when sections of mattress 20 are inclined. Moreover, the mattress cover of mattress 20 that stretches between balancing bars 24-25 and the lower edge 32 of bottom foam layer 31 at foot section 29 provides only a limited area for the elastic bottom of a fitted sheet to tighten around the bottom of bottom foam layer 31. A fitted sheet, also called a bottom sheet, is a sheet that covers a mattress and has an elastic seam that pulls the sheet together around the bottom of the mattress and helps the sheet to stay in place over the mattress. Alternatively, the fitted sheet has elastic sewn into the bottom of each of the four corners instead of an entire seam.

Figure 3:
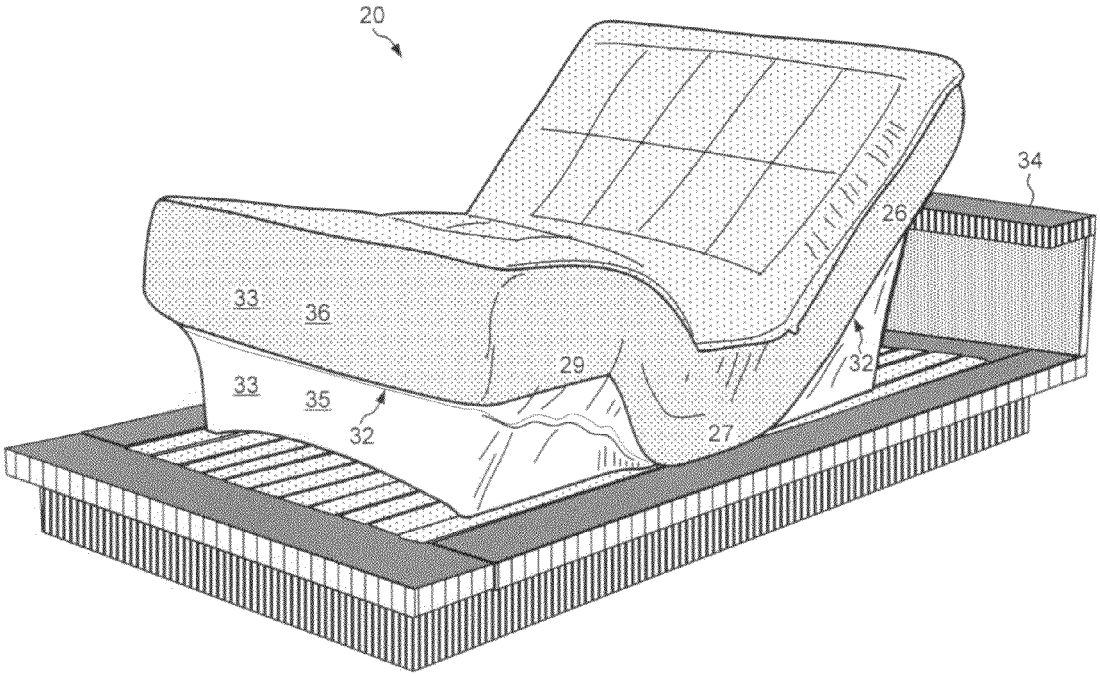
FIG. 3 is a perspective view of the adjustable mattress of FIG. 2 with a mattress covering in an inclined configuration on a platform bed.

FIG. 3 is a perspective view of adjustable mattress 20 with balancing bars 24-25 and integrated movement mechanism 23 covered by a novel mattress covering 33. Mattress 20 is resting directly on the supporting surface of a platform bed 34 in an inclined configuration. The balancing bars of the embodiment of FIG. 3 extend farther out under foot section 29 than do the balancing bars of FIG. 2. Thus, when mattress covering 33 stretches between balancing bars 24-25 and the lower edge 32 of bottom foam layer 31, the angle that stretchable covering 33 makes between foot section 29 and the balancing bars is closer to vertical. As the balancing bars approach the length of the foam layers, there is less narrowing in mattress covering 33 from the foam layers to the balancing bars that can provide a lip for a fitted sheet to tighten around the bottom of the foam layers. In the embodiment of FIG. 3, mattress covering 33 is made from two types of fabric. Only a bottom portion 35 that stretches from bottom foam layer 31 to balancing bars 24-25 is made of Spandex® or Lycra® fabric. The top portion 36 of mattress covering 33 is made of a softer and thicker fabric that is more easily patterned. Bottom portion 35 of mattress covering 33 that stretches between the balancing bars and bottom foam layer 31 prevents pets and small children from being under self-adjusting mattress 20 when the mattress is returned to the flat configuration after being in an included configuration. Thus, in addition to keeping dust away from movement mechanism 23 and any exposed shafts and bars, mattress covering 33 also has a safety function.

Figure 4:
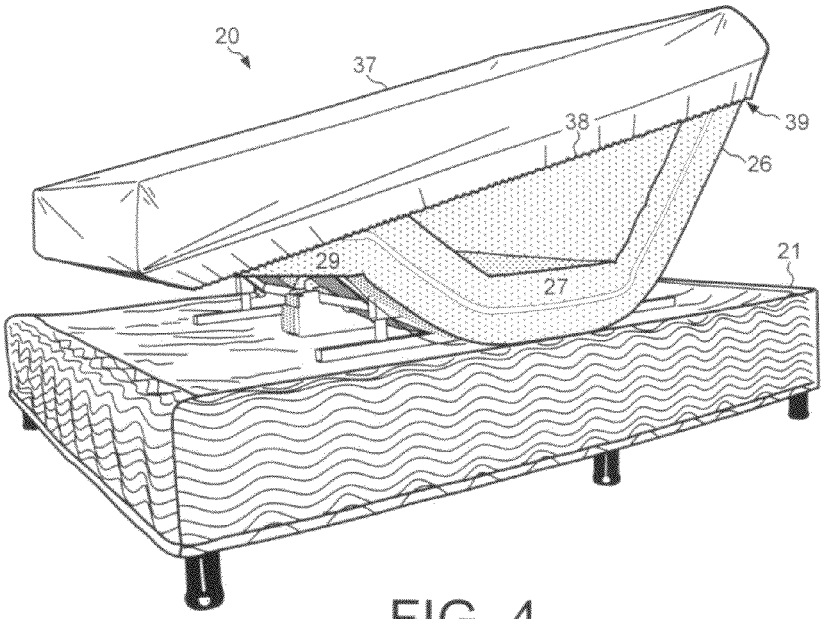
FIG. 4 shows the adjustable mattress of FIG. 2 in an inclined configuration with a fitted sheet suspended between the inclined shoulder and foot sections of the mattress.

FIG. 4 illustrates what occurs with a fitted sheet 37 that is placed on mattress 20 when mattress 20 is inclined to an orientation for reading or watching television. The elastic band 38 of fitted sheet 37 tightens the bottom edge 39 such that the sheet is suspended from the top of shoulder section 26 to the bottom of foot section 29. Although an occupant sitting in inclined mattress 20 would hold fitted sheet 37 to the upper surface of hip section 27, fitted sheet 37 would nevertheless hammock between the top of shoulder section 26 and the bottom of foot section 29. Any bedding placed on top of fitted sheet 37 would also ride up with fitted sheet 37. Mattress covering 33 and a fitted sheet of the present invention solve these problems.

Figure 5:
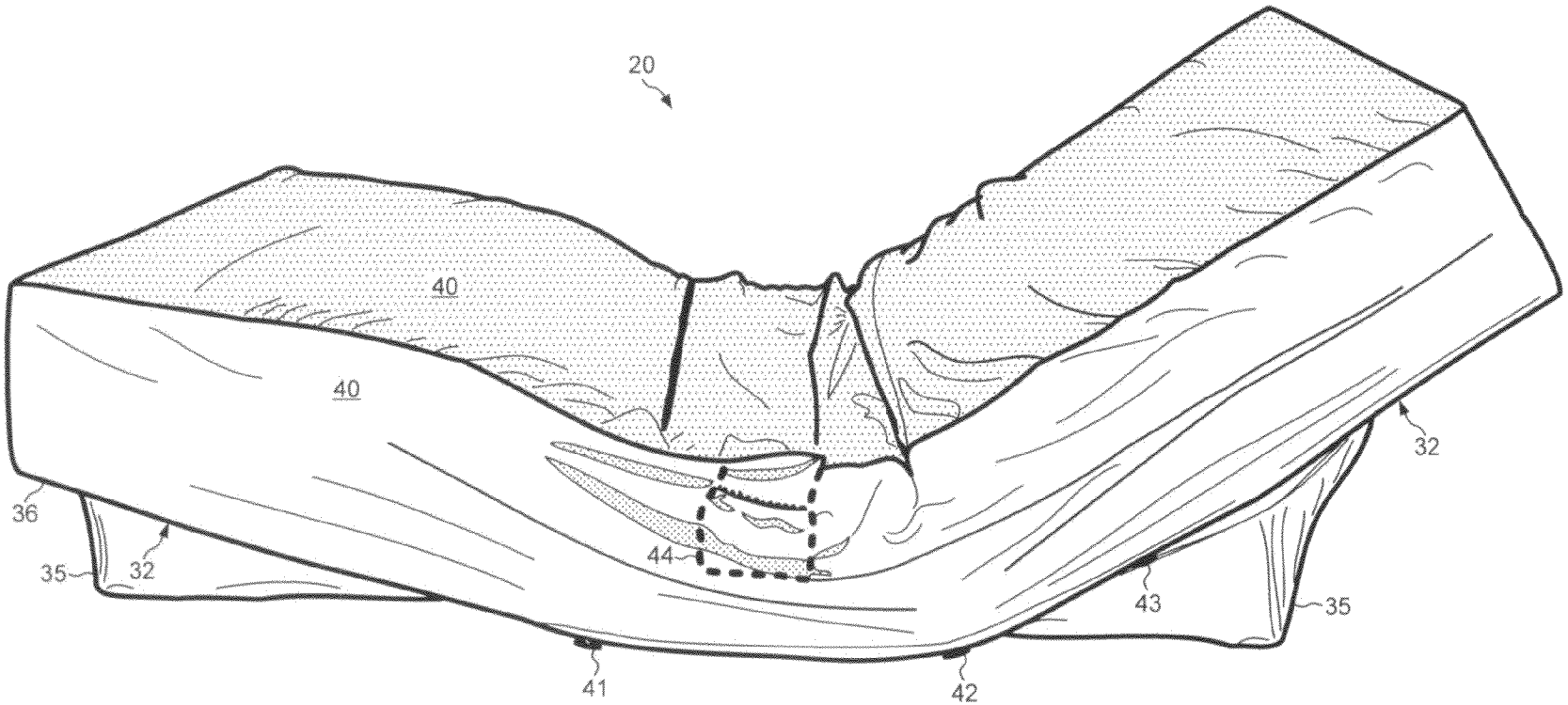
FIG. 5 is a perspective side view of a novel fitted sheet over the adjustable mattress of FIG. 3.

FIG. 5 is a perspective side view of a fitted sheet 40 over adjustable mattress 20 in a semi-inclined configuration. Fitted sheet 40 fits over mattress covering 33 and remains in place on mattress covering 33 even when adjustable mattress 20 is in an inclined configuration. Fitted sheet 40 is held in place by fastener members that are attached to mattress covering 33 near the lower edge 32 of adjustable mattress 20. About ten fastener members are attached to top portion 36 of mattress covering 33 around the seam with bottom portion 35. Three fastener members 41-43 on mattress covering 33 are visible in FIG. 5. Each fastener member is adapted to fasten to a corresponding fastener on fitted sheet 40. For example, in an embodiment in which fastener member 43 is a toggle, the corresponding fastener on fitted sheet 40 is a loop of an elastic band or cord. The toggle fits through the loop in a manner similar to an elongated button. Fitted sheet can easily be removed from mattress covering 33 by undoing the toggles. Because the toggles are attached to mattress covering 33 as opposed to fitted sheet 40, the loops on fitted sheet 40 can easily be machine washed without damaging any of the toggles. FIG. 5 also shows a pocket 44 that is stitched to the outside of fitted sheet 40. Pocket 44 can be used to hold the remote control device that controls the configurations of adjustable mattress 20.

In the embodiment of FIG. 5, fitted sheet 40 is fabric made of cotton, polyester or wool or a mix of materials. In another embodiment, however, fitted sheet 40 is made of leather. Alternatively, the parts of fitted sheet 40 that cover the four side surfaces of adjustable mattress 20 are made of fabric, whereas the part that covers the upper surface of adjustable mattress 20 is made of leather. The leather "fitted sheet" is appropriate when adjustable mattress 20 is used as an adjustable chaise lounge. For example, a brown leather fitted covering would allow adjustable mattress 20 to be used in a living room and could be decoratively coordinated with a leather sofa and chairs.

Figure 6:
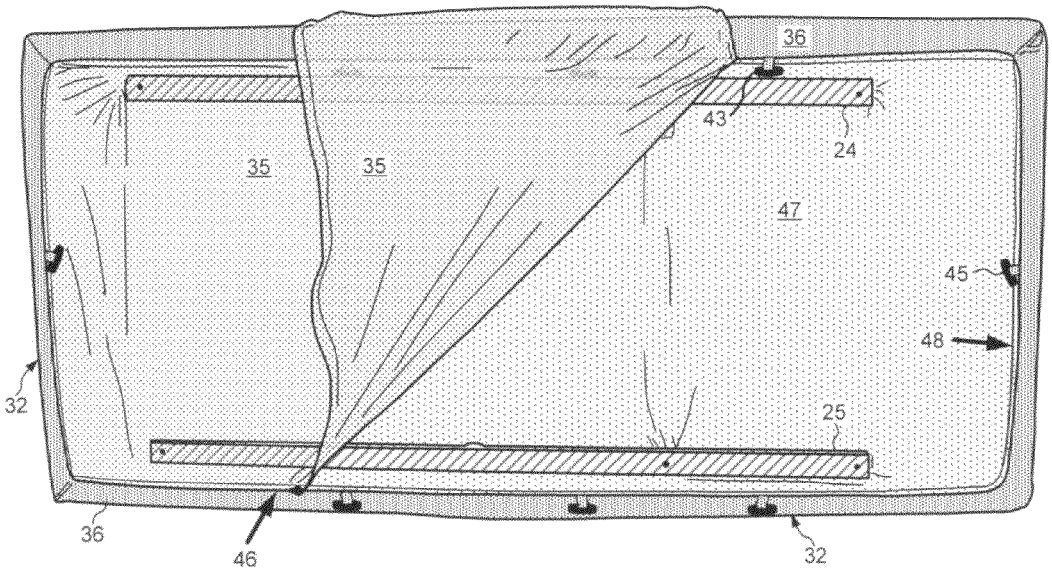
FIG. 6 shows the bottom of the adjustable mattress of FIG. 2 in a flat configuration.

FIG. 6 shows the bottom of adjustable mattress 20 of FIG. 3 in a flat configuration. Eight of the ten fastener members are visible that are attached to mattress covering 33 near the lower edge 32 of bottom foam layer 31. FIG. 6 shows a fastener member 45 that holds fitted sheet 40 in place at the top of shoulder section 26. Mattress covering 33 actually has two bottom portions. The bottom portion 35 that is apparent in FIG. 3 is attached to the perimeter of top portion 36 with a zipper 46. Bottom portion 35 is made of a very stretchable fabric and covers the bottom surfaces of balancing bars 24-25. The boundary of top portion 36 and bottom portion 35 along zipper 46 is the extent of the lip around the bottom of the foam layers where the elastic band of a fitted sheet pulls the sheet tight around the bottom of the foam layers. A second bottom portion 47 is attached to the perimeter of top portion 36 at a second zipper 48 just inside of zipper 46. Second bottom portion 47 covers the bottom surface of bottom foam layer 31 but is situated between bottom foam layer 31 and balancing bars 24-25. When mattress 20 is positioned from the flat configuration to an inclined position, second bottom portion 47 remains adjacent to the bottom surface of bottom foam layer 31, while bottom portion 35 stretches between balancing bars 24-25 and bottom foam layer 31.

Figure 7:
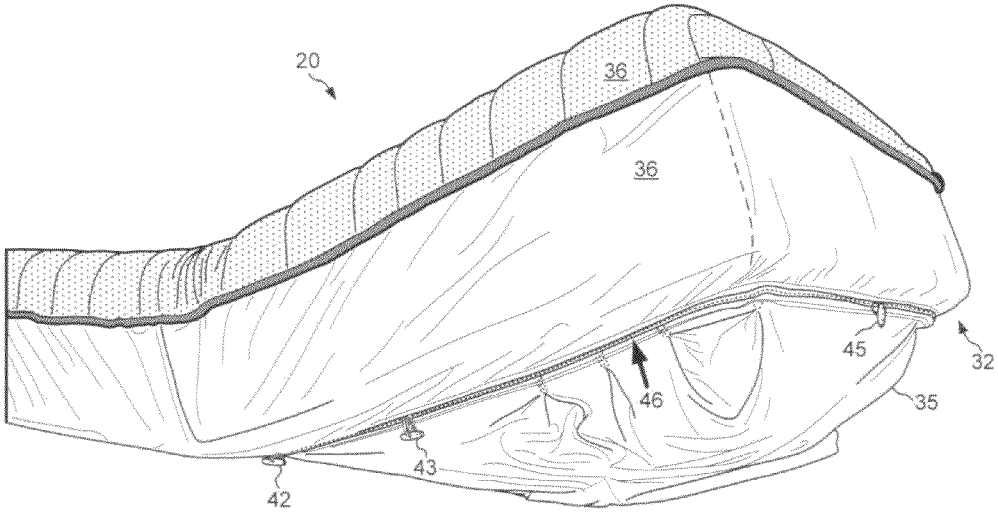
FIG. 7 shows a novel mattress covering at the shoulder section of an adjustable mattress in a partially inclined configuration.

FIG. 7 shows mattress covering 33 at shoulder section 26 of adjustable mattress 20 in a partially inclined configuration. FIG. 7 shows bottom portion 35 of mattress covering 33 beginning to stretch from balancing bars 24-25 to lower edge 32 of bottom foam layer 31. Fastener member 43 is a toggle that is hanging down from the bottom edge of top portion 36 of mattress covering 33. Toggle 43 has not yet been inserted through a loop on a fitted sheet. In other embodiments, other types of fastener members and fasteners are used besides toggles and loops. For example, mattress covering 33 and fitted sheet 40 can be held together using a button and a button hole or a male snap fastener and a female snap fastener. In addition, a hook fastener strip and a loop fastener strip, such as Velcro® can be used. Tie strings on mattress covering 33 and fitted sheet 40 could also be used to attach the bottom edge of fitted sheet 40 to the bottom edge of top portion 36 of mattress covering 33.

Figure 8:
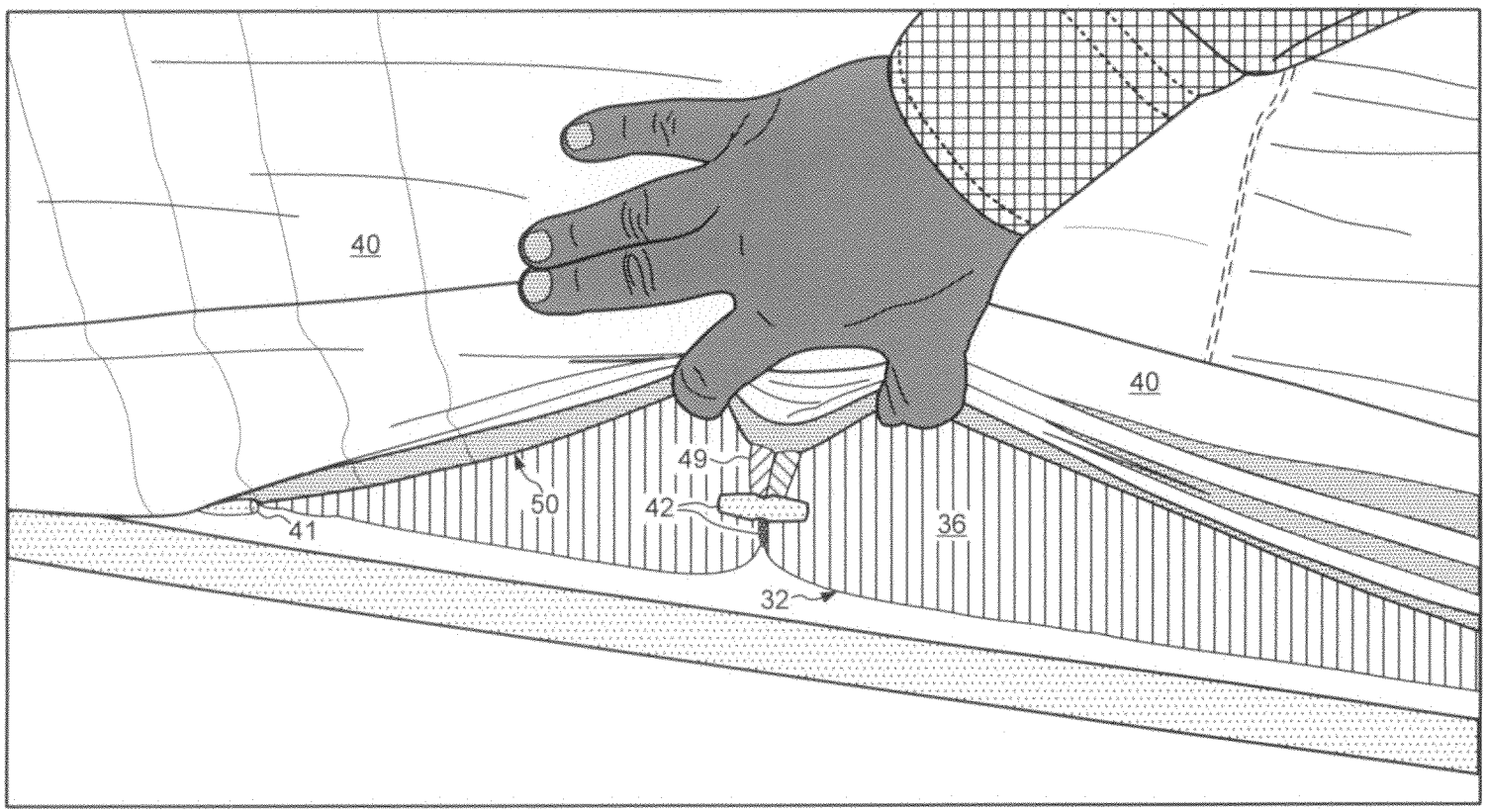
FIG. 8 shows in more detail how a fastener member of the mattress covering of FIG. 7 holds a fitted sheet in place on the adjustable mattress.

FIG. 8 shows in more detail how fastener member 42 is used to hold fitted sheet 40 in place on adjustable mattress 20. Fastener member 42 is a toggle that passes through a fastener 49 on fitted sheet 40. Fastener 49 is an elastic loop attached to the bottom edge 50 of fitted sheet 40. In the embodiment of FIG. 8, in addition to elastic loops, an elastic band is also used to keep fitted sheet 40 in place over mattress covering 33. The elastic band is sewn into a hem at bottom edge 50 of fitted sheet 40. The elastic band draws fitted sheet 40 taut around adjustable mattress 20 below lower edge 32 of bottom foam layer 31. A lip around the lower edge 32 where bottom portion 35 of mattress covering 33 starts to stretch to the balancing bars provides an area for the elastic band of fitted sheet 40 to fit around mattress 20.

Figure 9:
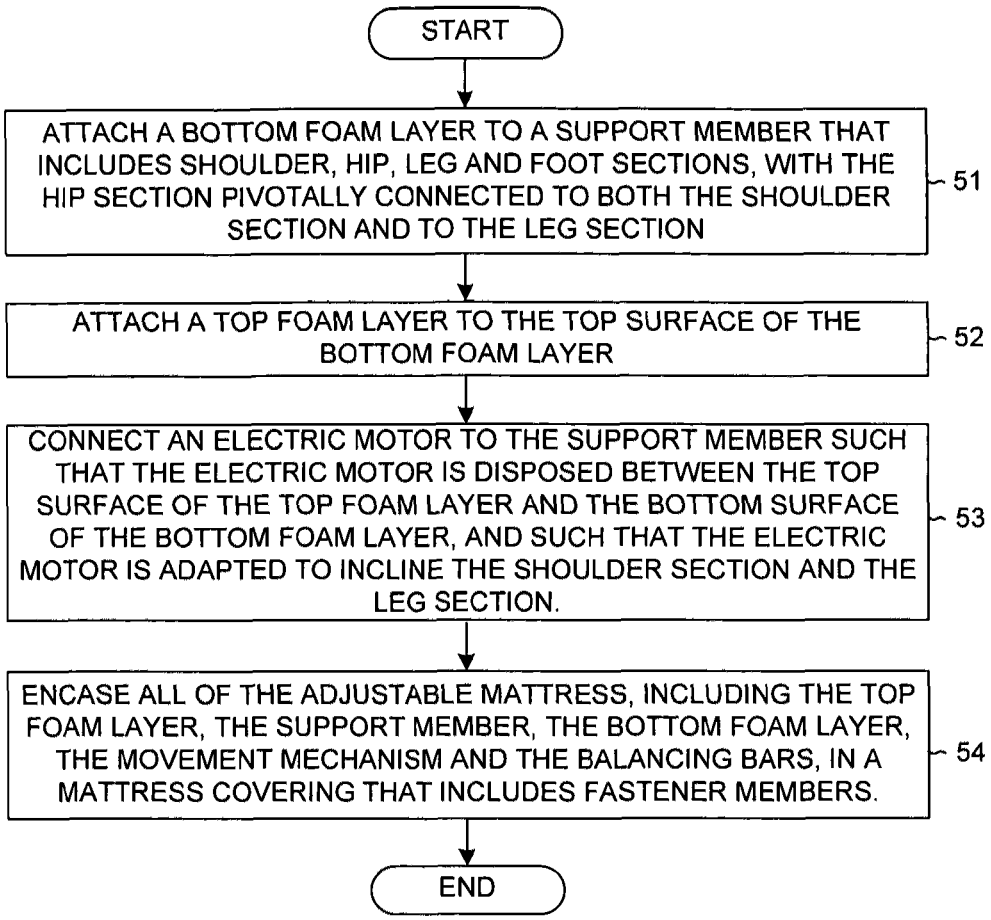
FIG. 9 is a flowchart of steps of a method of making the adjustable mattress of FIG. 5 with a fabric covering adapted to hold a fitted sheet in place when the adjustable mattress inclines.

FIG. 9 is a flowchart illustrating steps 51-54 of a method of making adjustable mattress 20 with a fabric covering adapted to hold a fitted sheet in place when the adjustable mattress inclines.

In a first step 51, bottom foam layer 31 is attached to a support member by molding foam around the bars and metal mesh of the support member. A template is used to mold HD foam above, below and through the holes of metal mesh panels between the bars of the support member. The support member includes shoulder section 26, hip section 27, leg section 28 and foot section 29. Hip section 27 is pivotally connected to both shoulder section 26 and to leg section 28.

In step 52, top foam layer 30 is attached to bottom foam layer 31. In one embodiment, top foam layer 30 is a slab of cut memory foam that is glued to the top surface of bottom foam layer 31. In another embodiment, top foam layer 30 is memory foam that is molded over and adheres to the top surface of bottom foam layer 31. After step 52, the support member is disposed entirely between the top surface of top foam layer 30 and the bottom surface of bottom foam layer 31.

In step 53, an electric motor is connected to the support member such that the electric motor is disposed between the top surface of top foam layer 30 and the bottom surface of bottom foam layer 31. The electric motor is part of movement mechanism 23 and is adapted to incline shoulder section 26 and leg section 28.

In step 54, top foam layer 30, the support member and bottom foam layer 31 are encased in fabric covering 33. Mattress covering 33 also encases movement mechanism 23 and balancing bars 24-25. Mattress covering 33 includes fastener members attached to the fabric covering near the perimeter 32 of the bottom surface of bottom foam layer 31. The fastener members are adapted to fasten to corresponding fasteners on fitted sheet 40. Each fastener member serves as a means for holding bottom edge 50 of fitted sheet 40 around lower edge 32 of adjustable mattress 20 when the adjustable mattress is in an inclined position. In one embodiment, the fastener members are toggles, and the corresponding fasteners are loops. Top portion 36 of mattress covering 33 is first fitted over the foam layers of mattress 20, and second bottom portion 47 is attached to the perimeter of top portion 36 using second zipper 48. Second bottom portion 47 covers the bottom surface of bottom foam layer 31 but is situated between bottom foam layer 31 and balancing bars 24-25. Then balancing bars 24-25 are connected to the support member. Zipper 46 is then used to attach bottom portion 35 of mattress covering 33 to top portion 36 of mattress covering 33 and thereby also cover balancing bars 24-25.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a separable mattress covering that encases an adjustable mattress, wherein the adjustable mattress has a lower edge and a bottom surface, and wherein the mattress covering covers the bottom surface; and a fastener member that is attached to the mattress covering near the lower edge of the adjustable mattress, wherein the fastener member is adapted to fasten to a corresponding fastener on a fitted sheet to hold a bottom edge of the fitted sheet around the lower edge of the adjustable mattress when the adjustable mattress is in a non-flat position.

2. The apparatus of claim 1, wherein the fitted sheet has an elastic band that draws the fitted sheet taut around the adjustable mattress.

3. The apparatus of claim 1, wherein the fastener member is a toggle, and wherein the corresponding fastener is a loop.

4. The apparatus of claim 1, wherein the fastener member and the corresponding fastener are taken from the group consisting of: a toggle and a loop, a button and a button hole, a male snap fastener and a female snap fastener, a hook fastener strip and a loop fastener strip, and a tie string and a corresponding tie string.

5. The apparatus of claim 1, wherein the mattress covering has an upper portion and a lower portion, wherein the lower portion is made of stretchable fabric, and wherein the lower portion stretches between the lower edge of the adjustable mattress and a balancing bar that supports the adjustable mattress when the adjustable mattress is inclined.

6. The apparatus of claim 1, wherein the adjustable mattress has a top surface, wherein an electric motor is disposed between the top surface and the bottom surface, and wherein the electric motor is adapted to incline the adjustable mattress.

7. The apparatus of claim 1, wherein the fitted sheet includes a pocket adapted to hold a remote control device used to control the adjustable mattress.

8. An adjustable mattress, comprising:

a separable mattress covering that encases the adjustable mattress, wherein the adjustable mattress has a lower edge and a bottom surface, and wherein the mattress covering covers the bottom surface; and means for holding a bottom edge of a fitted sheet around the lower edge of the adjustable mattress when the adjustable mattress is in a non-flat position, wherein the means is attached to the mattress covering near the lower edge of the adjustable mattress.

9. The adjustable mattress of claim 8, wherein the means fastens to a fastener that is attached to the fitted sheet.

10. The adjustable mattress of claim 8, wherein the adjustable mattress has a leg section, a hip section and a shoulder section, and wherein the means holds the bottom edge of the fitted sheet at the lower edge of the hip section of the adjustable mattress when leg section and the shoulder section of the adjustable mattress are inclined.

11. The adjustable mattress of claim 10, further comprising:

an electric motor, wherein the electric motor is adapted to incline the shoulder section and the leg section.

12. The adjustable mattress of claim 8, wherein the fitted sheet has an elastic band that draws the fitted sheet taut around the adjustable mattress.

13. The adjustable mattress of claim 8, wherein the means comprises a plurality of toggles.

14. The adjustable mattress of claim 8, wherein the mattress covering has an upper portion and a lower portion, wherein the lower portion is made of stretchable fabric, and wherein the lower portion stretches between the lower edge of the adjustable mattress and a balancing bar that supports the adjustable mattress when the adjustable mattress is in the inclined position.

* * * * *